US006974392B2

(12) United States Patent
Chang

(10) Patent No.: US 6,974,392 B2
(45) Date of Patent: Dec. 13, 2005

(54) GOLF CLUB FOR MINIMIZING SPIN OF GOLF BALL

(76) Inventor: Dale U. Chang, 2900 Sun Bittern Ct., Windermere, FL (US) 34786

( * ) Notice: Subject to any disclaimer, the term of this patent is extended or adjusted under 35 U.S.C. 154(b) by 0 days.

(21) Appl. No.: 10/122,873

(22) Filed: Apr. 15, 2002

(65) Prior Publication Data

US 2002/0111228 A1 Aug. 15, 2002

Related U.S. Application Data

(63) Continuation-in-part of application No. 09/404,048, filed on Sep. 23, 1999, now Pat. No. 6,402,636, which is a continuation-in-part of application No. 08/917,971, filed on Aug. 27, 1997, now abandoned.

(51) Int. Cl.[7] ..... A63B 53/04
(52) U.S. Cl. ..... 473/324
(58) Field of Search ..... 473/324, 349, 473/342

(56) References Cited

U.S. PATENT DOCUMENTS

| | | | | |
|---|---|---|---|---|
| 4,159,286 A | | 6/1979 | Khattab et al. | |
| 4,471,961 A | | 9/1984 | Masghati et al. | |
| 4,532,054 A | | 7/1985 | Johnson | |
| 4,598,909 A | | 7/1986 | Ventura | |
| 4,812,187 A | | 3/1989 | Honma | |
| 4,960,279 A | | 10/1990 | Harris, Jr. | |
| 5,011,151 A | | 4/1991 | Antonious | |
| 5,011,738 A | * | 4/1991 | Saclier | 428/422 |
| 5,016,883 A | | 5/1991 | Kobayashi | |
| 5,029,865 A | * | 7/1991 | Kim | 473/330 |
| 5,120,358 A | | 6/1992 | Pippett | |
| 5,182,093 A | * | 1/1993 | Cann | 423/446 |
| 5,423,535 A | | 6/1995 | Shaw et al. | |
| 5,425,989 A | | 6/1995 | Ogawa et al. | |
| 5,485,998 A | | 1/1996 | Kobayashi | |
| 5,587,209 A | | 12/1996 | Soga et al. | |
| 5,603,664 A | | 2/1997 | Provost | |
| 5,643,110 A | | 7/1997 | Igarashi | |
| 5,702,827 A | | 12/1997 | Itoh et al. | |
| 5,703,166 A | | 12/1997 | Rajagopalan et al. | |
| 5,743,812 A | | 4/1998 | Card | |
| 5,744,549 A | | 4/1998 | Lutz | |
| 5,779,560 A | | 7/1998 | Buck et al. | |
| 5,797,807 A | | 8/1998 | Moore | |
| 5,836,827 A | | 11/1998 | Ogawa et al. | |
| 5,851,158 A | | 12/1998 | Winrow et al. | |
| 5,885,171 A | | 3/1999 | Sharpe | |
| 6,010,533 A | * | 1/2000 | Pope et al. | 623/22.15 |
| 6,030,294 A | | 2/2000 | Shira | |
| 6,059,670 A | | 5/2000 | Mogan | |
| 6,089,992 A | * | 7/2000 | Onuki et al. | 473/324 |
| 6,090,456 A | * | 7/2000 | Wu et al. | 427/577 |
| 6,217,464 B1 | | 4/2001 | Chang | |

FOREIGN PATENT DOCUMENTS

| | | | |
|---|---|---|---|
| JP | 52026929 | | 2/1977 |
| JP | 5-209297 | * | 8/1993 |
| JP | 408052243 | | 2/1996 |

* cited by examiner

*Primary Examiner*—Stephen Blau

(57) ABSTRACT

A golf club having a ball-contacting surface formed by a very thin layer of lubricant for reducing the spin imparted to a golf ball. By maintaining the thickness of lubricant exposed at the ball-contacting surface to be less than 20 microns, the integrity of the lubricant layer is improved and the mechanical locking effect between the soft lubricant and the golf ball is minimized. The thin lubricating layer may be supported by a reinforcing structure to convey the force of the golf ball impact to the club head without indentation of the thin lubricating layer.

4 Claims, 3 Drawing Sheets

GOLF CLUB FOR MINIMIZING SPIN OF GOLF BALL

This application is a continuation in part of, and claims the benefit of the Sep. 23, 1999, filing date of, application Ser. No. 09/404,048, now issued as U.S. Pat. No. 6,402,636, which is a continuation in part of abandoned application Ser. No. 08/917,971, filed Aug. 27, 1997 abandoned, to which priority is claimed.

FIELD OF THE INVENTION

The present invention relates to golf clubs and, more particularly, to a golf club that minimizes the spin rate of a golf ball stuck by the club.

BACKGROUND OF THE INVENTION

The majority of commercially available golf balls are advertised as having high spin rates since such spin rates are desirable for the better golfer. A high spin rate in a golf ball indicates that the ball rotates very rapidly about its axis when struck by the skilled player. The advantage of the high spin rate is that the ball can be made to produce a reverse or backspin so that the ball stops very quickly when hit into a green on an approach shot.

While high spin rates are desirable for a highly skilled golfer, most amateur golfers are not capable of hitting a ball in a manner to produce controlled spin on the ball. More importantly, most amateur golfers have a swing that is either an inside-out or outside-in swing that produces side spin on the ball. Side spin causes the ball to move laterally off a desired target line, i.e., in either a hook or slice direction. For such amateur golfers, it is desirable to eliminate or at least substantially reduce spin of the ball so that the ball travels in essentially a straight line from the clubface without the detrimental curved caused by side spin. Further, eliminating most of the ball spin will cause the ball to travel a farther distance in a desired direction.

U.S. Pat. No. 5,423,535 issued to Shaw, et al on Jun. 13, 1995, teaches that it is desirable to provide a golf club having a ball-contacting face piece with a low friction characteristic. Materials identified by Shaw for the face piece include PTFE, which is generally considered a low friction material and has a coefficient of friction of approximately 0.05–0.15, and other materials that are generally considered not to have a low friction characteristic. Shaw teaches a variety of shapes and materials for the face piece of a golfing "iron" club wherein the shape of the face piece is selected to control the weight distribution and the flexural modulus of the club head.

U.S. Pat. No. 5,743,812 issued to Card on Apr. 28, 1998, describes a golf driver having a layer of PTFE forming a ball-contacting surface. The layer of PTFE is described as the SUPRA® coating system available from E. I. DuPont de Nemours & Co. and applied by a known spray/dry/cure process. The layer of PTFE has a cured thickness of between 20–40 microns ($\mu$m). This patent describes the coating as being effective to provide the clubface with a kinetic coefficient of friction that is less than about 50% of the kinetic coefficient of friction of a similar driver club not having the coating. Such measurements were conducted in accordance with ASTM D-1894-93 standard test methods where a golf ball was pulled across various test panels and the static and kinetic coefficients of friction were measured.

SUMMARY OF THE INVENTION

The present invention addresses the above stated and other disadvantages associated with striking a golf ball with a glancing or sliding blow from a golf club by providing a golf club that is specially adapted with a ball striking face portion that slips against the ball surface so as to minimize spin imparted to the ball.

A golf club is described herein as including: a shaft; a head attached to the shaft; and a layer of lubricating material disposed on the head to form a ball-contacting surface, the layer of lubricating material comprising a topmost lubricating layer having a thickness of less than 20 microns at the ball-contacting surface. The topmost lubricating layer may alternatively have a thickness of less than 10 microns or 5 microns or 1 micron at the ball-contacting surface. The layer of dry lubricant may be deposited on the head by a vacuum deposition process to achieve the desired degree of thinness. The golf club may further include a reinforcing structure for resisting indentation of the topmost lubricating layer when the ball-contacting surface is exposed to a force of a golf ball impact. The reinforcing structure may be a polymer matrix containing lubricant, with the concentration of lubricant being greater in a region proximate the ball-contacting surface than in a region proximate the head. The reinforcing material may be fibers of a reinforcing material, or it may be peaks and valleys of material on a surface of the golf club head, with the lubricant being disposed over the peaks and valleys. The reinforcing structure provides a ball-contacting surface having a Rockwell C hardness value of at least 20 or at least 35. The golf club may further include: a supporting layer of material disposed under the topmost lubricating layer; and a layer of lubricant disposed between the head and the supporting layer of material, and the thickness of the supporting layer may be less than the thickness of the topmost lubricating layer.

A golf club is describe herein as including a ball-contacting surface formed by the vacuum deposition of a dry lubricant to a thickness of less than 20 microns, or less than 10 microns, or less than 5 microns, or less than 1 micron over an underlying support structure. The golf club ball-contacting surface may be formed by the vacuum deposition of alternating layers of dry lubricant and a supporting material, with a topmost lubricating layer being formed by the vacuum deposition of dry lubricant to a thickness of less than 20 microns.

BRIEF DESCRIPTION OF THE DRAWINGS

For a better understanding of the present invention, reference may be had to the following detailed description taken in conjunction with the accompanying drawings in which.

DETAILED DESCRIPTION OF THE PREFERRED EMBODIMENTS

Figure 1:
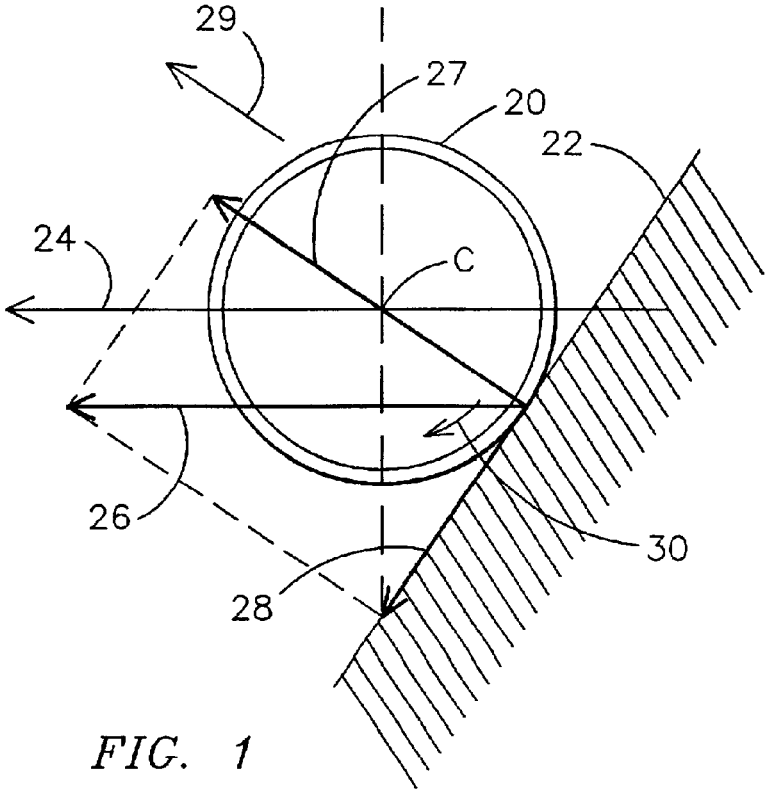
FIG. 1 illustrates the effect of an angled clubface striking a golf ball
Figure 2:
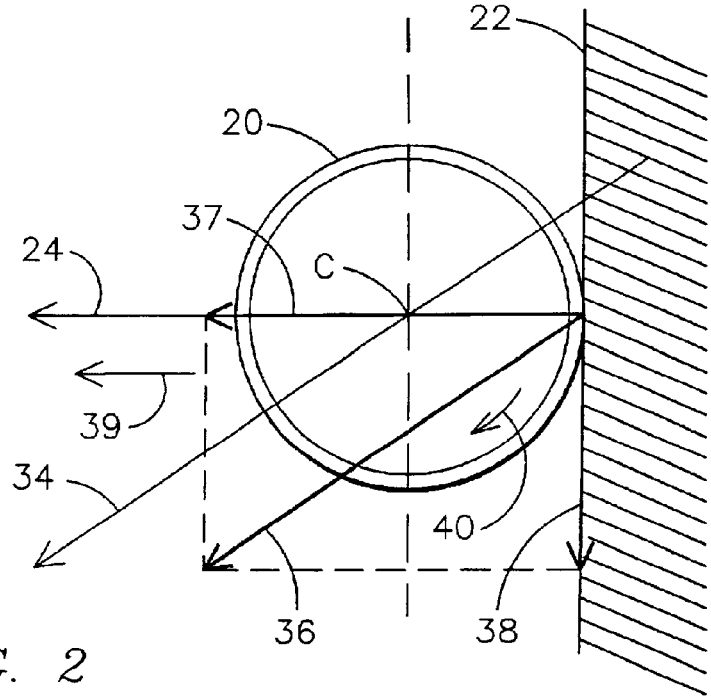
FIG. 2 illustrates the effect of a clubface striking a ball when the face is square to a target line and the path of club travel is off line.

In order to understand the mechanism by which the present invention reduces the tendency of a golf ball to spin and thus impart sideways motion to the golf ball, reference is now made to FIGS. 1 and 2 which illustrate the various forces imposed on a golf ball 20 by a clubface 22 striking the ball with either the clubface in an open position with respect to a desired line of flight (target line) of the ball or with the clubface square to the desired target line but with the direction of impact being at an angle to the desired target line. Turning first to FIG. 1, the clubface 22 is shown in an open position with respect to the desired target line 24. As a result, the clubface initially contacts the ball 20 at a point inside (with respect to the golfer's position) the target line 24 which extends through the center C of the ball, thus causing the hitting force 26 to be divided into a normal force component 27 and a tangential force component 28. The normal force 27 is used to carry the ball in the ball flight direction 29 while the tangential force 28 generates a moment about the center C of the ball causing the ball to rotate as indicated by the arrow 30. The tangential force 28 is reduced if the coefficient of friction between the clubface 22 and the ball is lowered. The spin imparted to the s golf ball, in this example, a clockwise spin, causes the ball to have a "slicing" path of travel, i.e., to move in a curved direction from the initial path indicated by normal force line 27.

A similar result occurs if the clubface 22 is actually square to the target line 24, but approaches the target line at an angle such as that indicated at 34 of FIG. 2. In this example, the clubface 22 initially contacts the ball 20 at a point on the target line 24 extending through the center C of the ball, but the direction of travel of the club creates a hitting force 36 that includes normal force component 37 and tangential force component 38. The normal force 37 is used to carry the ball in the ball flight direction 39 while the tangential force 38 generates a moment about the center of the ball causing the ball to rotate as indicated by the arrow 40. As a result, the ball leaves the clubface in the general direction 39 of the target line but then deviates into a slice or clockwise motion away from the target line. Similar action occurs but in an opposite or "hook" direction if the club direction of travel is inside out rather than outside in.

In both the actions illustrated in FIG. 1 and in FIG. 2, if the frictional force (tangential forces 28 and 38) between the clubface and the ball can be reduced so that the ball is not imparted with a spinning motion by its impact with a club, then the ball will have more of a tendency to travel in a straight line as it leaves the club. Such reduction in frictional force can be achieved by making the clubface 22 "slippery" so that the clubface slips on the ball surface and the tangential force 28 or 38 is reduced to concurrently reduce the amount of spin imparted to the ball. Although the ball flight in FIG. 1 is not likely to be in the desired direction, i.e., along the target line 24, it will at least fly in a generally straight direction rather than veering substantially off the initial ball flight path due to the spin on the ball. In the situation illustrated in FIG. 2., the ball will actually move along the target line 24 even though the path of the clubface is not along that target line. If the spin imparted to the ball by the clubface can be completely eliminated, the ball flight path can be straight even though the clubface is not moving in that target line direction.

The present inventor has found that the device of Shaw described in U.S. Pat. No. 5,423,535 is ineffective in reducing the spin of the golf ball even when the face piece is selected to be a low friction lubricating PTFE material. Because the face piece of Shaw must be relatively thick in order to affect the weight distribution and flexural modulus of the club head, the low friction materials taught by Shaw will indent heavily when subjected to the force of a golf ball impact. This force can be in the range of 1,000 to 2,000 pounds. The stress at the point of impact may be 1,500 to 5,000 pounds per square inch. The indentation of the face piece of Shaw results in a mechanical locking action between the face piece and the dimpled ball, thereby providing the high friction to impart significant spin to the ball in spite of a low coefficient of friction characteristic of the face piece material. In one experiment, the inventor attached a plate of PTFE of approximately 0.030 to 0.060 inch thickness to the ball-contacting surface of a driver club. The ball left a deep and clear ball dimple indentation pattern on the PTFE face. This indicated that the ball was "locked" on the PTFE hitting face at impact. Due to heavy indentation of the PTFE, there was no sign of slipping of the ball on the PTFE surface, and the ball sliced or hooked badly when hit with a purposefully poor swing. Thus, the low friction materials taught by Shaw do not function as a low friction ball contact surface under high impact loads due to the softness of these materials. Furthermore, the softness of the lubricating material tends to reduce the distance of travel of the golf ball.

The present inventor also finds that the standard test methods described by Card in U.S. Pat. No. 5,743,812 are of limited value for predicting the performance of a low-friction coating on a golf club ball-contacting surface. The mechanical deformation identified in the above-described test conducted by the inventor will not occur during the standard test methods described by Card. Accordingly, the Card patent fails to recognize the mechanical locking effect identified by the present inventor, and it fails to recognize the importance that such locking effect may have on the amount of spin imparted to a golf ball. It has also been found that a thick coating may be detached from the surface of the golf club due to the force of a golf ball impact, and may become chipped out due to cracking. The chipped area no longer holds the lubricating material and the purpose of that layer is lost.

The inventor has discovered that it is advantageous to utilize a coating layer of relatively soft, low friction lubricating material on the ball-contacting surface of a golf club provided that the coating is kept sufficiently thin so that any indentation of the lubricating material during impact with a ball is minimized, and the mechanical locking effect is minimized or eliminated. Such a lubricating layer may be applied directly to a face portion of the body of the club head, or it may be applied to a hard insert that is attached to the club head. The dimension of concern herein is the thickness in a direction perpendicular to the ball-contacting surface of a topmost layer of the lubricant, as measured from the ball-contacting surface to an underlying support structure or supporting layer. Such underlying support structure may be the golf club head, or it may be a lubricant reinforcing material, or it may be a supporting layer as described more fully herein. If the lubricant is too thick, it will deform and mechanically interact with the ball to impart sidespin to the ball. The stresses in such a thick layer of lubricant due to a ball impact are tri-axial (x-y-z directions), and the lubricant may actually break and fall off of the ball-impacting surface as a result of such stresses. As the lubricant is made thinner, the stresses in the lubricant become primarily plane stresses (x-y directions) and the mechanical locking effect is reduced. Furthermore, the integrity of the lubricating layer is improved as its thickness decreases, as discussed more fully below.

A thin layer of lubricant is resistant to any deformation in the direction of its thickness. This phenomenon has been noted in other examples of thin coatings of materials. For example, glue is brittle, but a thin layer is very strong and tough. If the gap filled by the glue is too large, the glue does not form as strong a bond as with a thin gap. Also, the compressive pressure between the ball and the race of a ball bearing is extremely high, but in spite of such pressure, a thin layer of grease remains at the contact area for lubrication. Prior art golf clubs have failed to recognize the importance of this phenomenon to the art of golf club design. The thinness of the layer of lubricant in the present invention is important for maintaining the integrity of the layer without it being displaced, indented or deformed. If the thickness of the layer is maintained below 20 microns or less, the layer exhibits strong material strength, and thus does not deform easily in any direction including the thickness direction. As the thickness decreases, the force needed to deform or indent the layer increases exponentially. This is the reason why it is possible to have a thin grease film between the ball and the race of a ball bearing under high compressive stress even though the grease is soft and easily deformable.

In the present invention, the lubricant materials are relatively soft and easily deformable. However, if we maintain the thickness to less than 20 microns or less, then we can expect that the layer will not deform or indent under high compressive stresses. Any deformation of the layer is detrimental since it adds to the mechanical locking at the interface with the ball. Furthermore, repeated deformation may cause failure of the lubricant layer, such as flaking off from the clubface surface. The integrity of the layer will be maintained even at a high contact pressures if its thickness is very thin.

Figure 3:
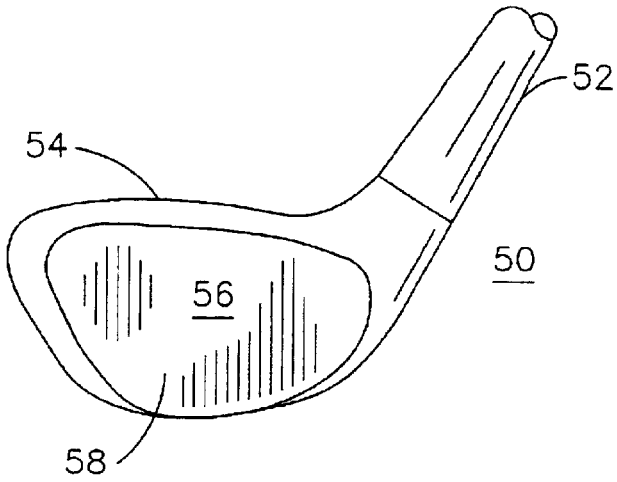
FIG. 3 is a partial perspective view of a golf club having a thin layer of a lubricating material forming a ball-contacting surface.

FIG. 3 illustrates a golf club 50 having a shaft 52 and a head 54 connected to the shaft in a manner known in the art. Golf club 50 has a ball-contacting surface 56 formed by a layer of lubricating material 58 disposed on the head 54. The layer of lubricating material 58 has a thickness of less than 20 microns in one embodiment, or alternatively less than 10 microns, or less than 5 microns, or less than 1 micron. The layer of lubricating material 58 may be a fluoropolymer or other dry lubricant, for example Algoflon from Ausimont USA, Inc.; Chemfluor form Norton Performance; Fluon from ICA Americas, Inc.; Hostaflon from Hoeschst Celanese; and Teflon from E. I. DuPont. Molybdenum disulfide or graphite may also be used as the dry lubricant. Fluoropolymers or fluororated polymers include, for example, as polytetrafluoroethylene (PTFE); fluorinated ethylene propylene (FEP); perfluoroalkoxyethylene (PFA); polychlorotrifluoroethylne (PCTFE); and ethylenetetrafluoroethylene copolymer (ETFE). Because the layer of lubricating material 58 is thin and is backed by a hard surface of the club head 54, indentation of the lubricating material 58 is essentially eliminated and no significant mechanical locking action is developed between the golf ball and the club head. The thin layer of lubricating material 58 will reduce the amount of spin imparted to the ball by approximately one-half or less when compared to the same club without the layer of lubricating material 58. Such improvement is unknown with prior art golf clubs. Furthermore, the distance of travel of the ball will be increased by the reduction of backspin. Lubricity of the ball-contacting surface 56 without a mechanism to prevent or minimize the indentation of the lubricating material 58 does not accomplish this improved result. The layer of lubricating material 58 may be thicker than the above-described dimensions provided that a reinforcing structure is included within the layer so that the thickness of a topmost lubricant layer disposed above the reinforcing structure is no more than the above-described dimensions. For example, a reinforcing material may be embedded in the layer 58 to minimize its indentation when impacted by a golf ball. The reinforcing material may be any material exhibiting a load bearing parameter that provides greater resistance to indentation than does the lubricant material. Examples of reinforcing materials include hard particles and strong fibers such as metal particles or fibers or fabrics, or ceramic particles or fibers or fabrics. The region of the lubricant containing the reinforcing material may be considered a supporting layer, and the topmost region of the lubricant that is above the supporting layer and that does not contain such reinforcing material may be considered a lubricating layer. The thickness of the lubricant in the lubricating layer at the ball-contacting surface 56 should be less than 20 microns, or less than 10 microns, or less than 5 microns, or less than 1 micron. The thickness of the final lubricating surface layer of the ball contacting area is minimized to maintain the integrity of the coating and to eliminate or minimize the indentation of the coating under the high ball contact pressure.

Figure 4:
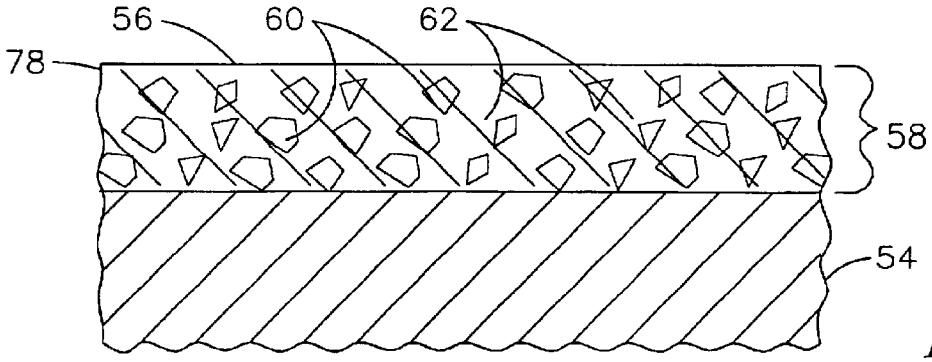
FIG. 4 is a partial cross-sectional view of a layer of lubricating material disposed on a golf club head having a dry lubricant uniformly distributed in a polymer matrix.

FIGS. 4–7 illustrate alternative embodiments of the layer of lubricating material 58 disposed on the club head 54 to form ball-contacting surface 56. In each of these embodiments, a reinforcing structure of a material having a load bearing property greater than a load bearing property of a lubricant is provided to resist indentation of a topmost lubricating layer when subjected to a force of a golf ball impact For golf club heads that are made of ferrous and non-ferrous metals such as steel, stainless steel, aluminum, copper, titanium and their alloys, fluoropolymer resin matrix coatings can be applied. This process bonds high release, low friction polymers, both singularly and in plural composition that have been dispersed uniformly in a durable resin binder matrix to the base metal surface. FIG. 4 illustrates a layer of lubricating material 58 disposed on a head 54 of a golf club 50 to form a ball-contacting surface 56. The layer of lubricating material 58 includes a dry lubricant 60 distributed in a matrix of polymer binder material 62. The polymer binder 62 may be, for example, an epoxy material, PPS or polyamide. The polymer matrix 62 forms a support structure in the layer of lubricating material 58 for carrying the force of a golf ball impact from the ball-contacting surface 56 to the head 54 with minimal indentation. The size and the concentration of the pockets of lubricant 60 are controlled to ensure that the thickness of the lubricant 60 exposed in a topmost lubricating layer 78 at the ball-contacting surface 56 is maintained below 20 microns, or below 10 microns, or below 5 microns, or below 1 micron to minimize any mechanical locking with the surface of the golf ball. As the ball-contacting surface 56 wears due to use, trapped pockets of lubricant 60 become exposed, and an additional quantity of lubricant 60 may be smeared across the ball-contacting surface 56, thus maintaining the desired thin topmost lubricating layer 78 of lubricant 60. Surface cleaning prior to the deposition of such a coating is important to ensure that layer 58 adheres to the golf club head 54. Final sintering is accomplished at curing temperatures typically ranging from 250 to 800° F. The values of the coefficient of friction are typically 0.08 for dynamic and 0.15 for static friction. Hardness of the layer of lubricating material 58 is typically 75 on the Shore D scale. The combination of the hardness of the ball-contacting surface 56 and the lubricity of the thin coating of lubricant 60 minimizes the spin imparted to a golf ball during a hard impact event.

Figure 5:
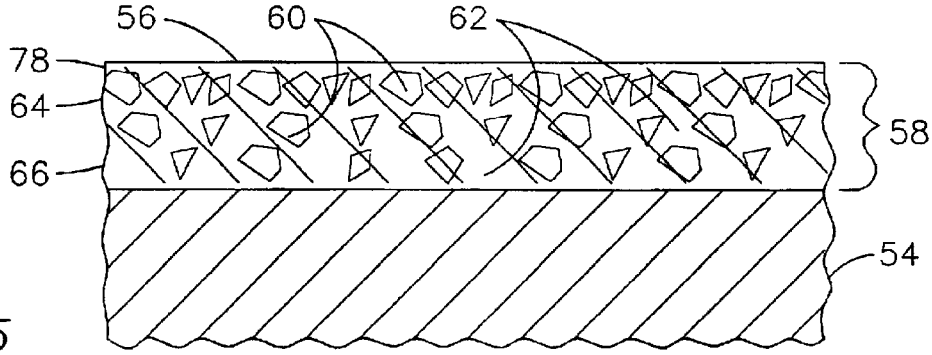
FIG. 5 is a partial cross-sectional view of a layer of lubricating material disposed on a golf club head having a dry lubricant distributed in a polymer matrix and having a higher concentration of lubricant proximate the ball-contacting surface.

FIG. 5 illustrates an embodiment similar to that of FIG. 4, except that the concentration of the dry lubricant 60 within the polymer matrix 62 varies across a depth of the layer of lubricating material 58. In the embodiment of FIG. 5, the concentration of the lubricant 60 is greater in the region 64 proximate the ball-contacting surface 56 than in the region 66 proximate the head 54. The relative concentrations of lubricant 60 and matrix material 62 is selected so that the thickness of the lubricant 60 exposed at the ball-contacting surface 56 is less than 20 microns, or less than 10 microns, or less than 5 microns, or less than 1 micron.

Figure 6:
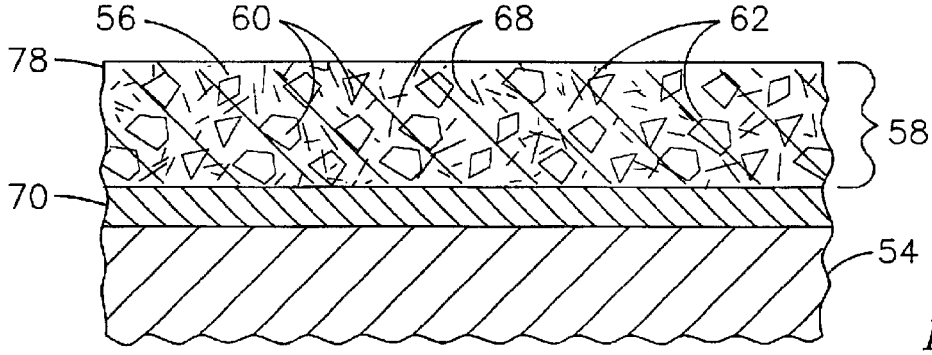
FIG. 6 is a partial cross-sectional view of a layer of lubricating material disposed on a golf club head and supported by a layer of polymer material containing reinforcing fibers.

FIG. 6 illustrates a layer of lubricating material 58 including a dry lubricant 60 and also a reinforcing material 68 dispersed in a polymer matrix material 62. The reinforcing material 68 may be metallic or ceramic micro-fibers, or it may be particles of a metal or ceramic, for example, for further reinforcing the matrix structure. The matrix material 62 and reinforcing material 68 form a reinforcing structure that resists indentation of the layer 58 upon impact with a golf ball. The reinforcing material 68 may be dispersed throughout the layer of lubricating material 58 or it may be confined to a subsurface region so that the individual fibers or particles do not become exposed at the ball-contacting surface 56. In either case, the thickness of a topmost layer of lubricant 60 exposed at the ball-contacting surface 56 is maintained to be less than 20 microns, or less than 10 microns, or less than 5 microns, or less than 1 micron. It may be advantageous to utilize a layer of bonding material 70, such as a polymer-based primer, between the head 54 and the layer of lubricating material 58 to improve the adhesion of the layer of lubricating material 58 to the head 54. The layer of bonding material 70 may be a polymer material and it is preferably maintained as thin as practical to minimize deformation when subjected to the force of a golf ball impact.

Figure 7:
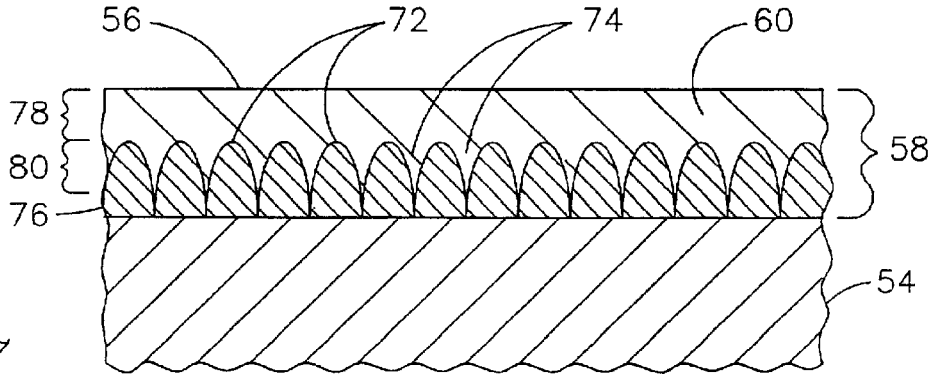
FIG. 7 is a partial cross-sectional view of a layer of lubricating material disposed on the peaks and valleys of a surface of a golf club head.

FIG. 7 illustrates an embodiment of the present invention wherein a layer of lubricant 60 is deposited over the peaks 72 and valleys 74 of a layer of flame-sprayed material 76 deposited onto the golf club head 54 to form the layer of lubricating material 58. This process consists of surface preparation followed by the deposition of molten or semi-molten particles of stainless steel or other alloys or ceramics under acceleration to form a hard and porous layer 76 on the base metal of head 54. This coating process is called plasma/thermal spraying. The peaks 72 of the flame-sprayed metal 76 function as a reinforcing structure having a load bearing property greater than a load bearing property of the lubricant 60 to resist indentation of the lubricant 60 when subjected to a force of a golf ball impact. The thickness of the lubricant 60 exposed above the peaks 72 of the layer of flame-sprayed material 76, i.e. lubricant layer 78, is maintained to be less than 20 microns, or less than 10 microns, or less than 5 microns, or less than 1 micron. The region below lubricant layer 78 that includes the peaks 72 and valleys 74 having lubricant 60 disposed therein may be considered a supporting layer 80 for the lubricant layer 78. In this embodiment, the supporting layer 80 provides a reservoir of additional lubricant 60 that may come to the ball-contacting surface 56 to supplement lubricant layer 78 as the golf club wears due to use.

The peaks 72 and valleys 74 of supporting layer 80 may be formed in ways other than with a flame-sprayed material. For example, the material of head 54 may be etched, such as with acid, or grit blasted, or micro-machined with mechanical or laser devices. Alternatively, a suitably rough surface having peaks 72 and valleys 74 may be formed by an oxide film or by the bonding of particles or fibers such as with epoxy or other adhesive or diffusion bonding. Alternatively, a cold spray process may be used to bond such particles.

Conventional spraying and dipping processes used for applying lubricating material coatings will produce a coating thickness of about 1 mil (25 microns) or more. For example, the three layers of PTFE used in the SUPRA® coating system described in the Card patent described above provide a lubricant layer of 20–40 microns. The layer of lubricating material 58 of the present invention may be applied with a vacuum deposition process, such as physical vapor deposition (PVD) or chemical vapor deposition (CVD). Such vacuum deposition processes are capable of producing the desired thin coating, such as less than 20 microns, or less than 10 microns, or less than 5 microns, or less than 1 micron. Known processes may be used to apply such materials. Lubricant is vaporized by heat in a vacuum chamber, and the vapor is uniformly deposited on the cleaned club head surface. The coating is very uniform and typically has a thickness in the sub-micron range.

Solid film lubricants may be applied to form the ball-contacting surface 56 of the golf club 50 to reduce golf ball spin. Thin films of resin bind lubricating particles such as molybdenum disulfide, graphite, silicone or fluoropolymers to the surface of the golf club head 54. Superior lubrication is accomplished with molybdenum disulfide in combination with graphite, and the mechanical locking effect is minimized by maintaining the thickness of the exposed lubricant to less than 20 microns, or less than 10 microns, or less than 5 microns, or less than 1 micron.

The above mentioned coating lubricating layers can be created by coating the clubface with a dry lubricant or a combination of dry lubricants such as PTFE, FEP, PFA, ECTFE, PCTFE, ETFE, other fluoropolymers, molybdenum disulfide, graphite, and lead. The coating process starts with a surface preparation as discussed above. This surface preparation is necessary to mechanically hold the dry lubricant on the clubface. For example, the metalizing or thermal spraying creates a porous metal particle layer on the clubface for the dry lubricant to be fused into the pores of the layer. The same effect is achieved by sintering fine metal particles on the clubface. This type of coating where the soft lubricating material is enclosed within the pores of a hard material is called an externally reinforced coating. In other cases, the clubface is coated with an intermediary coating that will hold the dry lubricant coatings. A matrix coating as described above utilizes one or more polymer binders, such as epoxy resin, PPS or polyamide, combined with a dry lubricant such as PTFE, FEP, PFA, ECTFE, PCTFE, ETFE, molybdenum disulfide, graphite and other fluoropolymers. Any combination of the above dry lubricants along with other lubricants may be used. For instance, addition of molybdenum disulfide to a PTFE (such as Teflon brand) may enhance the slipperiness of the coating layer. One variation of the matrix coating is a stratified coating. A stratified coating is a matrix coating where the formulation keeps most of the low-friction agent on the surface of the coating. Finally, internally reinforced coatings use microfilaments or other reinforcement materials to provide a mechanical reinforcement of the lubricant coating layer. Often times these coatings may be fused at a curing temperature of 100 to 800 degrees F for adhesion and durability of the coating. In each of these embodiments, it is desired to maintain the thickness of the lubricant exposed at the ball-contacting surface 56 to less than 20 microns, or less than 10 microns, or less than 5 microns, or less than 1 micron, in order to minimize or eliminate any mechanical locking effect that would add spin to the golf ball and to maintain the integrity of the lubricant layer.

The amount of lubricant may vary with the type of lubricant being used. The amount used should be sufficient to provide the slippery surface without compromising the strength or hardness of the ball-contacting surface. It will be noted that silicone fluid is a possible lubricant and that silicone fluid is not a solid lubricant. Other lubricants of this type could be used, including petroleum based lubricants (oil and grease), providing that the lubricants are modified such that the ball-contacting surface is slippery without being "wet". Examples of synthetic lubricants which can be formulated in this manner are: polyglycols, phosphate esters, chlorofluorolubricants, polypheny esters, silicones, dibasic acid esters (or diesters), esters, polyethers, polyaromatics, silicate esters, and highly fluorinated compounds.

Figure 8:
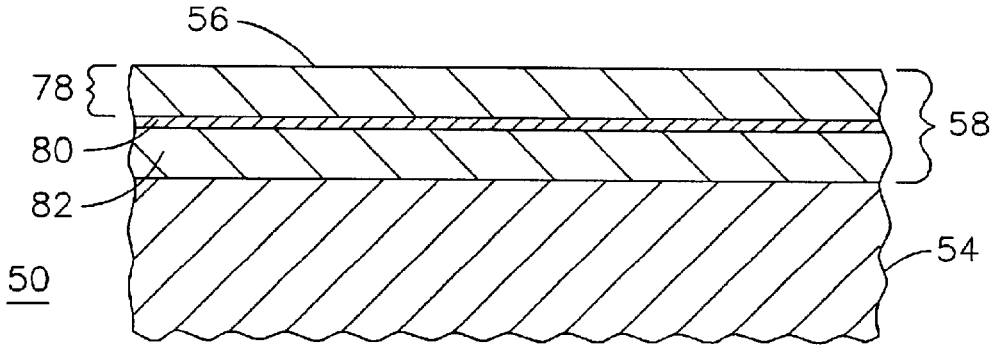
FIG. 8 is a partial cross-sectional view of a layer of lubricating material having a supporting layer of metal disposed under a thin lubricating layer.

FIG. 8 illustrates a further embodiment of the present invention wherein the layer of lubricating material 58 includes a thin lubricating layer 78 disposed over a thin supporting layer 80, which in turn is disposed over an additional layer of lubricant 82. Lubricating layer 78 has a thickness of less than 20 microns, or less than 10 microns, or less than 5 microns, or less than 1 micron. The supporting layer 80 may be metal or ceramic and is preferably deposited to be thinner than the lubricating layer 78, for example less than 10 microns, or less than 5 microns, or less than 1 micron. The additional layer of lubricant 82 provides a reservoir of lubricant in the event of wear of the ball-contacting surface 56. One may appreciate that additional alternating layers of lubricant and supporting material may be provided, but that for purposes of illustration, only three such layers are illustrated in FIG. 8. A layer of bonding material (not shown) may be provided between the club head 54 and the first layer of lubricant 82.

Figure 9:
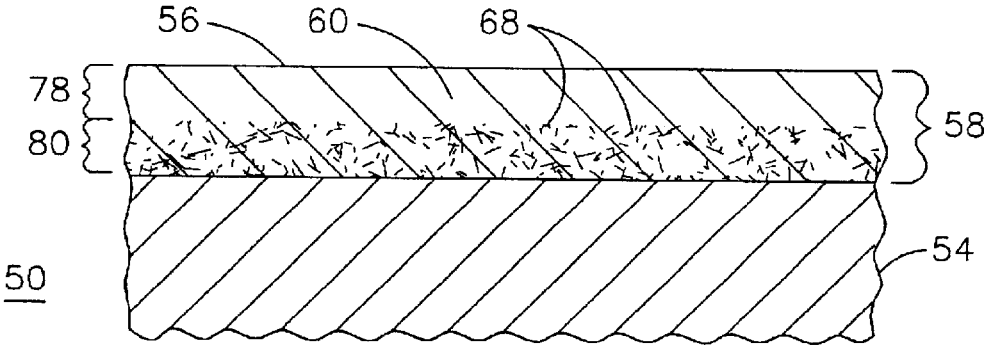
FIG. 9 is a partial cross-sectional view of a golf club head having a lubricating layer disposed over a supporting layer of lubricant containing a reinforcing material.

FIG. 9 is a further embodiment of a golf club 50 having a head 54 with a lubricating layer 58 defining a ball-contacting surface 56. In this embodiment, a reinforcing material 68 dispersed throughout a supporting layer 80 disposed between the head 54 and a topmost lubricating layer 78. The reinforcing material 68 may be a metal fabric, metal felt, metal or ceramic fiber or particles of a material harder than the lubricant 60, and it functions as a matrix material for supporting the lubricant 60, such as does rebar in concrete. The reinforcing material 68 may be evenly dispersed throughout supporting layer 80 or it may have a concentration per unit volume that varies with depth. The topmost lubricating layer 78 containing no reinforcing/matrix material 68 has a thickness of less than 20 microns, or less than 10 microns, or less than 5 microns, or less than 1 micron. The supporting layer 80 may have any thickness so long as it provides adequate mechanical support for lubricating layer 78.

While conventional golf clubs are generally designed to provide maximum friction between a golf ball and the clubface, this invention is directed to providing a golf club that minimizes such friction to thereby reduce the spin rate of a ball struck by the club. Accordingly, it may also be desirable to construct the face of the golf club with a smooth surface, free of any grooves or indentations. Conventional grooves may be present on the clubface. In this case, the effectiveness of the lubricating layer is reduced due to the mechanical locking of the grooves. However, a fine groove may act as valleys or reservoirs to hold lubricating materials while the non-grooved areas support the ball impact. Such grooves should be fine enough so as not to create mechanical locking with the ball during impact.

It may be appreciated that a golf club having a ball-contacting surface that is both hard and slippery may be manufactured by a variety of known processes and may take a variety of different shapes. A hardness on the Rockwell C scale of greater than 20 is desired, with various embodiments having hardness greater than 25 of greater than 35 or greater than 45. A static coefficient of friction of no more than 0.3 is desired, with various embodiments having a static coefficient of friction of no more than 0.24 or 0.20, or 0.15 or 0.05. The lubricity of the surface may be achieved by applying a coating of lubricating material, provided however that the thickness of that coating should be less than 20 microns, with various embodiments having a thickness of less than 5 microns or less than 1 micron. The coating may be externally reinforced, internally reinforced or a matrix coating. By maintaining the thickness of the lubricant exposed at the ball-contacting surface to be very thin, the effect of the softness of the material is minimized when compared to the benefit provided by the reduction of friction.

While the invention has been described in what is presently considered to be a preferred embodiment, many variations and modifications will become apparent to those skilled in the art. Accordingly, it is intended that the invention not be limited to the specific illustrative embodiment but be interpreted with the full spirit and scope of the appended claims.

I claim as my invention:

1. A golf club comprising:

a shaft;

a head attached to the shaft; and one or more layers of lubricating material disposed on the head to form a ball-contacting surface, wherein the combined thickness of said one or more layers comprises a thickness of 10 microns or less at the ball contacting surface;

wherein the lubricating material comprises fluoropolymer, PTFE, FEP, PFA ECTFE, PCTFE, ETFE, molybdenum disulfide, graphite, or lead, or combinations thereof; and wherein a concentration of the lubricant within the polymer matrix varies across a depth of the polymer matrix.

2. The golf club of claim 1, wherein the concentration of the lubricant is greater in a region proximate the ball-contacting surface than in a region proximate the head.

3. A golf club comprising:

a shaft;

a head attached to the shaft; and a layer of lubricating material disposed on the head to form a ball contacting surface, the layer of lubricating material comprising a topmost lubricating layer having a thickness of less than 20 microns at the ball-contacting surface;

wherein the layer of lubricating material further comprises a reinforcing structure for resisting indentation of the topmost lubricating layer when the ball-contacting surface is exposed to a force of a golf ball impact;

wherein the reinforcing structure comprises a polymer matrix containing lubricant; and wherein a concentration of the lubricant within the polymer matrix varies across a depth of the polymer matrix.

4. The golf club of claim 3, wherein the concentration of the lubricant is greater in a region proximate the ball-contacting surface than in a region proximate the head.

* * * * *